US008998673B2

(12) United States Patent
Martinez

(10) Patent No.: US 8,998,673 B2
(45) Date of Patent: Apr. 7, 2015

(54) TOY WITH PROJECTILE LAUNCHER

(71) Applicant: Ruben Leonard Martinez, Whittier, CA (US)

(72) Inventor: Ruben Leonard Martinez, Whittier, CA (US)

(73) Assignee: Mattel, Inc., El Segundo, CA (US)

( * ) Notice: Subject to any disclaimer, the term of this patent is extended or adjusted under 35 U.S.C. 154(b) by 91 days.

(21) Appl. No.: 13/827,451

(22) Filed: Mar. 14, 2013

(65) Prior Publication Data

US 2013/0239935 A1 Sep. 19, 2013

Related U.S. Application Data

(60) Provisional application No. 61/611,759, filed on Mar. 16, 2012.

(51) Int. Cl.

| | |
|---|---|
| ***A63H 17/26*** | (2006.01) |
| ***F41B 3/04*** | (2006.01) |
| ***F41B 15/00*** | (2006.01) |
| ***F41B 7/08*** | (2006.01) |
| *A63B 69/40* | (2006.01) |

(52) U.S. Cl.
CPC . *F41B 3/04* (2013.01); *F41B 15/00* (2013.01); *F41B 7/08* (2013.01)

(58) Field of Classification Search
CPC ... A63H 17/02; A63H 17/006; A63H 17/008; A63H 33/003; F41B 7/00; F41B 7/003; F41B 7/08
USPC ..... 446/309, 311, 429–431, 435, 436, 465, 446/470, 473; 124/16, 56
See application file for complete search history.

(56) References Cited

U.S. PATENT DOCUMENTS

| | | | |
|---|---|---|---|
| 1,546,431 | A | 7/1925 | Brandt |
| 2,611,997 | A | 9/1952 | Solloway et al. |
| 2,651,997 | A | 9/1953 | Glass et al. |
| 2,765,582 | A | 10/1956 | Hurtado |
| 2,810,985 | A | 10/1957 | Bilder |
| 3,000,137 | A | 9/1961 | Vine |
| 3,430,899 | A | 3/1969 | Zopf |
| 3,572,715 | A | 3/1971 | Ramirez |
| 3,895,459 | A | 7/1975 | Morrison et al. |
| 4,109,411 | A | 8/1978 | Wetherell et al. |
| 4,192,093 | A | 3/1980 | Hamano |
| 4,382,347 | A | 5/1983 | Murakami |
| 4,464,860 | A | 8/1984 | Onodera |
| 4,512,690 | A | 4/1985 | Johnson |
| 4,685,894 | A | 8/1987 | Beny et al. |
| 4,737,135 | A | 4/1988 | Johnson et al. |
| 4,863,413 | A | 9/1989 | Schwarz |
| 4,988,320 | A | 1/1991 | Rankin et al. |

(Continued)

*Primary Examiner* — Kien Nguyen
(74) *Attorney, Agent, or Firm* — Cantor Colburn LLP

(57) ABSTRACT

A toy having a housing; a cover pivotally mounted to the housing for movement between a first position wherein an internal cavity of the housing is covered and a second position wherein access to the internal cavity is provided; a launching mechanism located within the internal cavity; a first projectile configured to be launched from the launching mechanism; a plurality of second projectiles configured to be launched from a plurality of projectile launchers secured to the housing; an actuation mechanism coupled to the cover, the launching mechanism and the plurality of projectile launchers, wherein operation of the actuation mechanism causes the cover to move from the first position to the second position and simultaneously launch the first projectile and the plurality of second projectiles from the launching mechanism and the plurality of projectile launchers.

20 Claims, 7 Drawing Sheets

(56) References Cited

U.S. PATENT DOCUMENTS

| | | | | |
|---|---|---|---|---|
| 5,045,012 | A | 9/1991 | Miller | |
| 5,064,399 | A | 11/1991 | Klitsner et al. | |
| 5,423,706 | A | 6/1995 | Chase | |
| 5,525,086 | A | 6/1996 | Gentile et al. | |
| 5,690,330 | A | 11/1997 | Ozawa | |
| 5,725,410 | A | 3/1998 | Robinson et al. | |
| 6,048,246 | A | 4/2000 | Forti et al. | |
| 6,280,280 | B1 | 8/2001 | Vicino et al. | |
| 6,343,969 | B1 | 2/2002 | Spector | |
| 6,773,329 | B2 | 8/2004 | Hornsby et al. | |
| 6,860,787 | B1 | 3/2005 | Woodhouse | |
| 7,018,264 | B2 | 3/2006 | Foster et al. | |
| 7,121,917 | B2 * | 10/2006 | Hardouin et al. | 446/470 |
| 7,591,471 | B2 | 9/2009 | Walterscheid | |
| 7,713,105 | B2 | 5/2010 | Barthold | |
| 7,811,151 | B2 | 10/2010 | Conrad | |
| 7,950,977 | B2 | 5/2011 | Sun et al. | |
| 2006/0270307 | A1 | 11/2006 | Montalvo et al. | |
| 2006/0272627 | A1 | 12/2006 | Martinez et al. | |
| 2006/0292958 | A1 | 12/2006 | Sun et al. | |
| 2007/0173174 | A1 | 7/2007 | Sun et al. | |
| 2010/0181720 | A1 | 7/2010 | Barthold et al. | |
| 2010/0197191 | A1 | 8/2010 | Norman et al. | |

* cited by examiner

TOY WITH PROJECTILE LAUNCHER

CROSS REFERENCE TO RELATED APPLICATIONS

This application claims the benefit of U.S. Provisional Patent Application Ser. No. 61/611,759 filed Mar. 16, 2012, the contents of which are incorporated herein by reference thereto.

BACKGROUND

Various embodiments disclosed herein are related to a toy, and more particularly to a toy for launching objects.

Toys for launching objects are popular with children, however, many such toys are similar in that an object is loaded into a launch mechanism of the toy, and whether by actuating a trigger or some other device, the object is released or otherwise projected from the toy.

Accordingly, it is desirable to provide a toy for launching objects that also provides additional entertainment and stimulation to the user.

SUMMARY OF THE INVENTION

In one embodiment, a toy is provided the toy having: a housing; a cover pivotally mounted to the housing for movement between a first position wherein an internal cavity of the housing is covered and a second position wherein access to the internal cavity is provided; a launching mechanism located within the internal cavity; a first projectile configured to be launched from the launching mechanism; a plurality of second projectiles configured to be launched from a plurality of projectile launchers secured to the housing; an actuation mechanism coupled to the cover, the launching mechanism and the plurality of projectile launchers, wherein operation of the actuation mechanism causes the cover to move from the first position to the second position and simultaneously launch the first projectile and the plurality of second projectiles from the launching mechanism and the plurality of projectile launchers.

In another embodiment, a toy vehicle is provided, the toy vehicle having: a cover pivotally mounted to the toy vehicle for movement between a first position wherein an internal cavity of the toy vehicle is covered and a second position wherein access to the internal cavity is provided; a launching mechanism located within the internal cavity; a first projectile configured to be launched from the launching mechanism, wherein the first projectile is received within the internal cavity and completely concealed by the cover on the cover is in the first position; a plurality of second projectiles configured to be launched from a plurality of projectile launchers secured to the toy vehicle; an actuation mechanism located on the toy vehicle and operably coupled to the cover, the launching mechanism and the plurality of projectile launchers, wherein operation of the actuation mechanism causes the cover to move from the first position to the second position and launch the first projectile and the plurality of second projectiles from the launching mechanism and the plurality of projectile launchers.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

Figure 1:
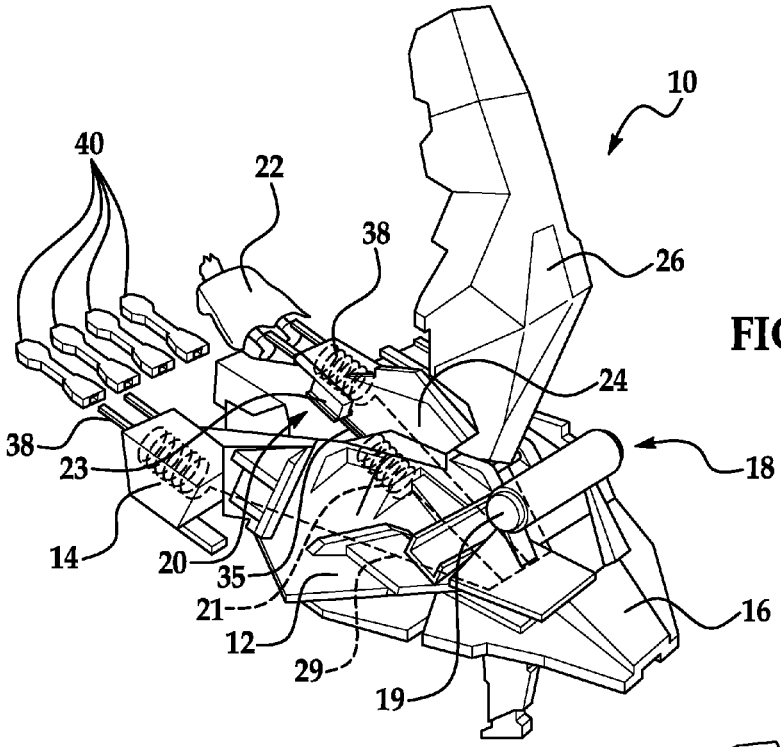
FIG. 1 is a perspective view of a toy in accordance with one embodiment of the present invention.

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

Referring now to the attached FIGS., a toy 10 constructed in accordance with one non-limiting embodiment is illustrated. As will be discussed herein, the toy has various embodiments, configuration or combinations wherein various embodiments according to the present invention can be implemented.

As shown in the attached FIGS., toy 10 includes a main housing 12 having a first end portion 14 and a second end portion 16. Associated with the second end portion is an actuation mechanism 18. In one non-limiting embodiment, the actuation mechanism 18 comprises a lever 19 pivotally mounted to the housing 12 of the toy 10. In yet another alternative embodiment, the actuation mechanism 18 comprises a button 21 movably mounted to a surface of the housing 12.

Received within the housing is a projectile launcher or launching mechanism 20. The projectile launcher or launching mechanism 20 is configured to launch a first projectile 22 from an internal cavity 24 of the housing 12. As will be described herein, the projectile launcher or launching mechanism 20 is operably coupled to actuation mechanism 18. The launching mechanism 20 includes a trigger mechanism operably coupled to the actuation mechanism 18 for launching the first projectile 22.

In one embodiment, the launching mechanism 20 will comprise a spring or other equivalent item 21 that is compressed when the first projectile 22 is secured to the launching mechanism 20. Securement of the first projectile 22 to the launching mechanism 20 is facilitated by a hook or feature that engages a portion of the first projectile 22 when it is secured to the launching mechanism 20 and the spring is in a compressed state such that the first projectile 22 will be retained upon the launch mechanism 20 until the biasing force of the compressed spring is released (e.g., movement of the hook or feature away from the first projectile 22 so that the biasing force of the spring 21 can be released and the first projectile 20 can be launched from the launching mechanism 20).

In other words, insertion of the first projectile 22 into the cavity 24 will cause the spring 21 of the launching mechanism 20 to be compressed and the first projectile 22 will be secured to the launching mechanism 20 with the spring in the compressed state and actuation of the trigger mechanism vis-à-vis actuation mechanism 18 will cause the biasing force of the compressed spring to be released and thus the first projectile 22 will be launched from the internal cavity 24. Of course, numerous other equivalent launching mechanisms are considered to be within the scope of exemplary embodiments of the present invention. For example, the projectile 22 is simply secured to a portion 23 of the launcher that is slidably received within a slot 35 in the cavity 24. In this embodiment and in order to retain the spring 21 in a compressed state a hook or feature will engage portion 23 and retain it in a location that corresponds to the compressed spring 21. Thereafter and in order to release the force of spring 21, the hook or feature is moved away from its engagement with portion 23 through actuation of mechanism 18. Accordingly, spring 21 is held in its compressed state by a movable hook or feature configured to engage portion 23 or projectile 22 when they are in a position corresponding to the compressed state of spring 21. Thereafter, the hook or feature is moved away from portion 23 or projectile 22 in order to allow the biasing force of spring 21 to be released. In one embodiment, the hook or feature may be spring biased into the position corresponding to its engagement with portion 23 or projectile 22. In one non-limiting embodiment, the movable hook or feature is operatively coupled to actuation mechanism 18 via a linkage 29 or any other suitable means in order to cause the desired movement of the same. One non-limiting example is illustrated schematically in FIGS. 3C-3F wherein compression of spring 21 is illustrated and movement of a hook 25 away from a corresponding feature 27 via a linkage 29 operably coupled to a lever 19 is also illustrated. It is, of course, understood that any spring biased projectile launching mechanism known to those skilled in the related arts is contemplated for use with exemplary embodiments of the present invention.

Figure 2A:
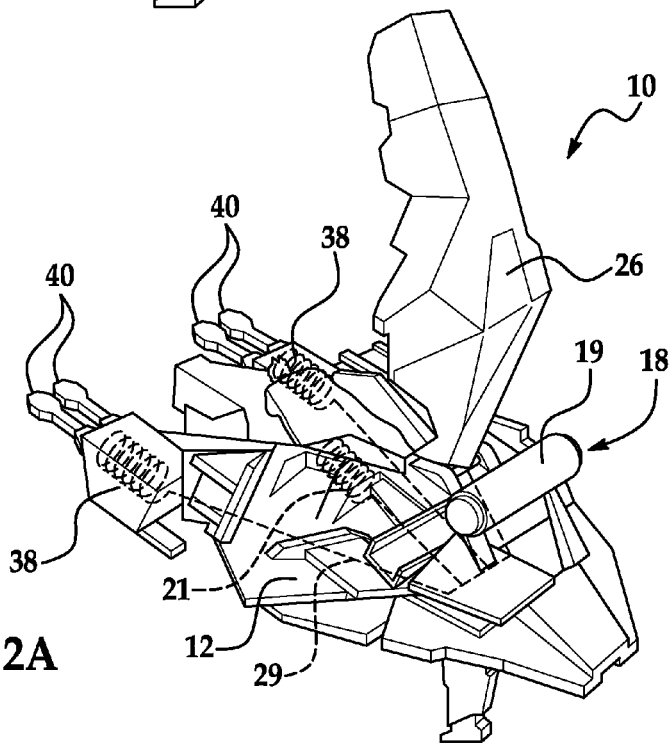
FIG. 2A-2C are views illustrating the toy launching projectiles therefrom.
Figure 2B:
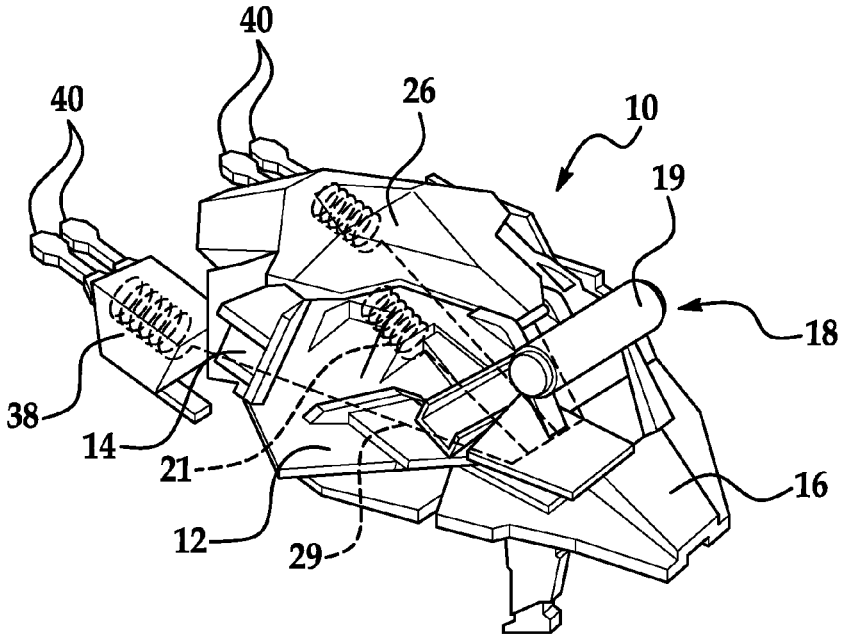
Figure 6:
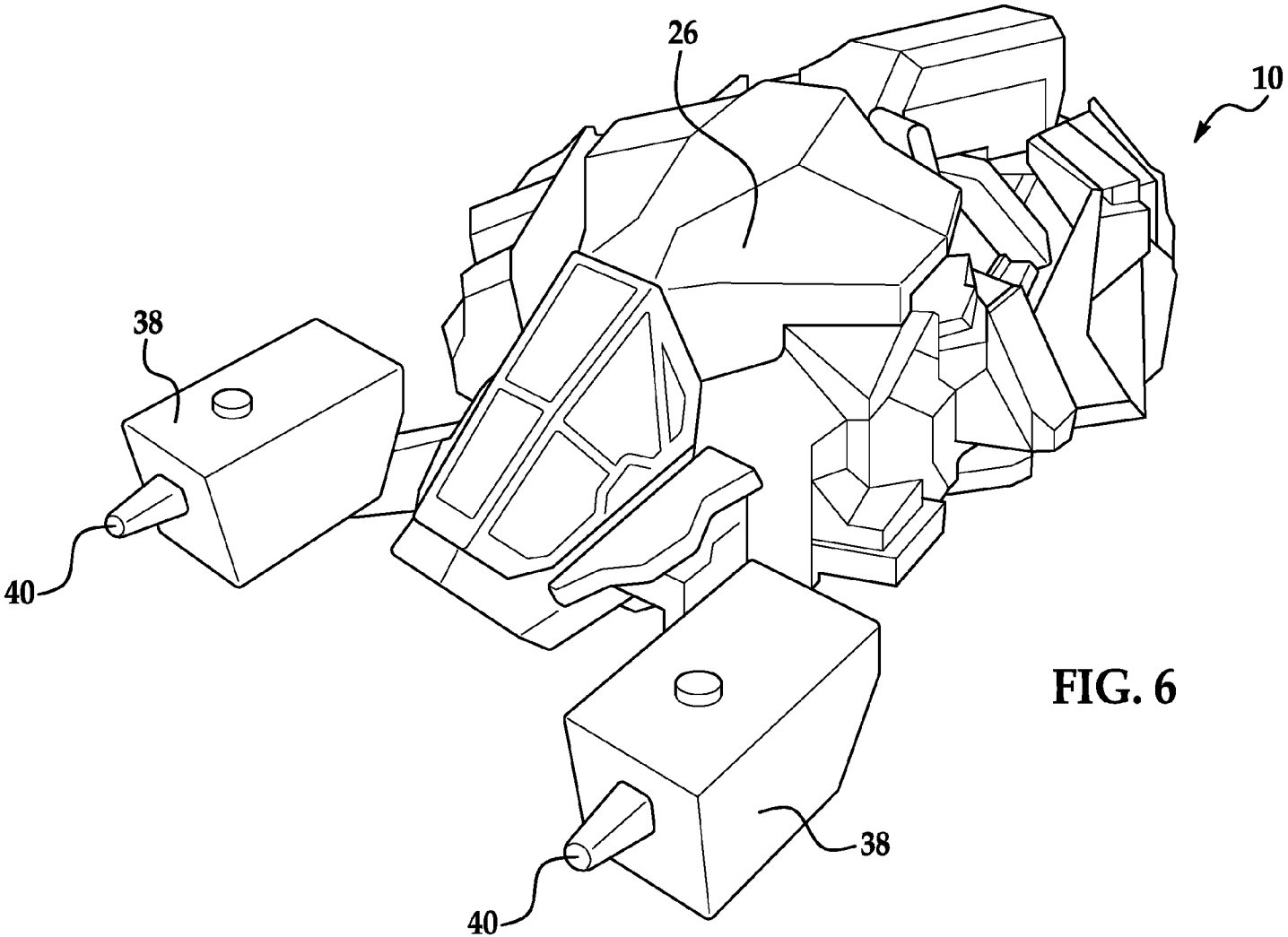
FIG. 6 is a view of an alternative embodiment of the present invention.

As illustrated in the attached FIGS., the toy 10 has a cover or canopy 26 pivotally mounted to the housing for movement between a first position (see at least FIGS. 2B and 6) wherein the internal cavity 24 of the housing 12 is covered and a second position (see at least FIGS. 1, 2A, 3A, 3B and 4A-4C) wherein access to the internal cavity 24 is provided.

In one non-limiting embodiment, the first projectile 22 is configured to resemble an action figure. In yet another embodiment, the first projectile further comprises an integrally molded wing member 30. In another embodiment, the action figure or first projectile 22 will be molded as a unitary structure having a wing member or airfoil 30 configured to assist in the aerodynamic capabilities of the first projectile 22. In still yet another embodiment, the first projectile 22 is configured to resemble an action figure and the integrally molded wing member 30 resembles a cape. In one embodiment, the wing member 30 is formed from an easily molded material such as plastic, foam and equivalents thereof wherein the wing member 30 has a sufficient amount of rigidity to provide aerodynamic assistance while also providing a somewhat flexible surface or material.

Figure 3A:
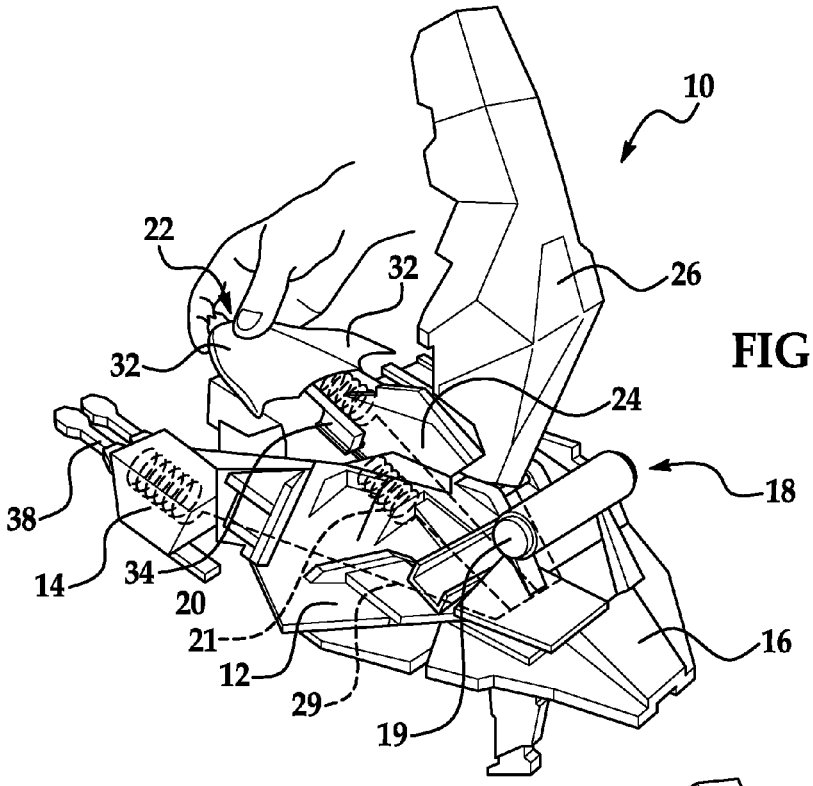
FIGS. 3A-3B are views of an alternative embodiment.
Figure 3B:
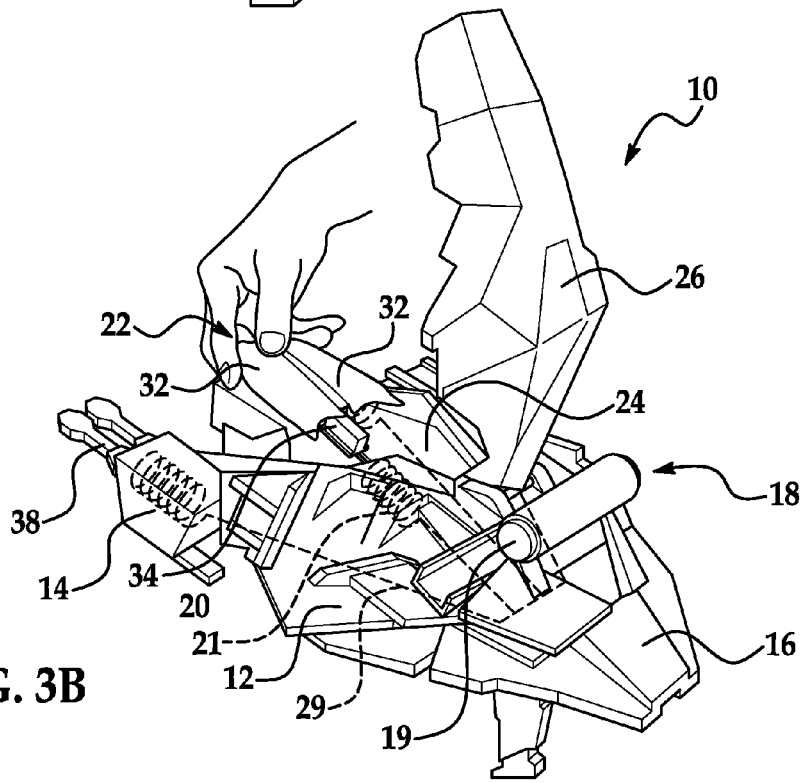
Figure 3C:
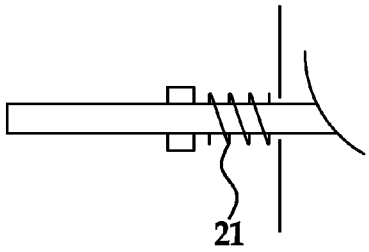
FIGS. 3C-3F are schematic illustrations of portions of an actuation and launching mechanism.
Figure 3D:
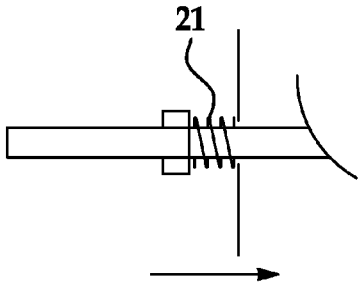
Figure 3E:
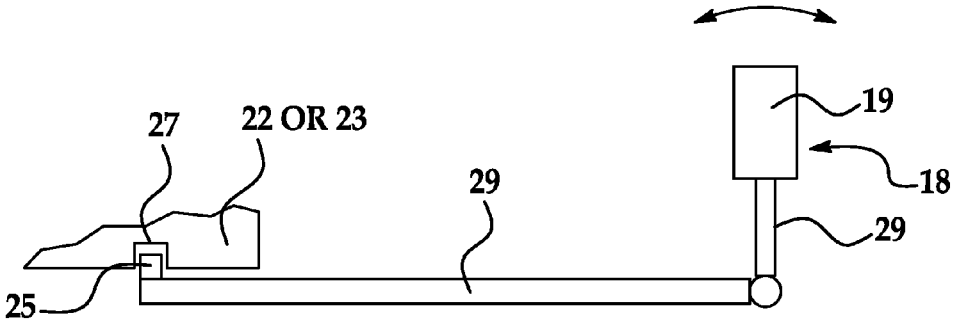
Figure 3F:
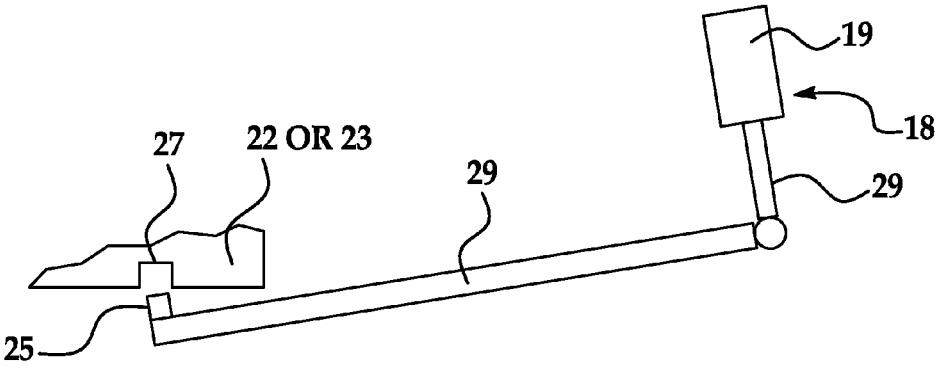

In yet another embodiment and as illustrated in FIGS. 3A and 3B, the wing member 30 comprises a pair of wing members 32 pivotally mounted to the first projectile 22 for movement between a first expanded position (see at least FIG. 3A) with respect to a main body portion 34 of the first projectile 22 and a second contracted position (see at least FIG. 3B) with respect to the main body portion 34. In one embodiment, the pair of wing members 32 are spring biased into the first expanded position and the internal cavity 24 is configured such that once the first projectile or action FIG. 22 is inserted into the internal cavity 24 and onto the launching mechanism 20, the pair of wing members 32 are pushed into in the second contracted position against the biasing force of the pair of wing members 32. In one embodiment, the pair of wing members 32 are integrally molded with the main body portion 34 and formed from a resilient material that provides a living hinge between the main body portion 34 and the pair of wing members such that the aforementioned movement can be provided. For example, the pair of wing members 32 may be formed out of a plastic material or elastomer that will allow for a biasing force to be provided. Alternatively, the pair of wing members may be pivotally mounted to the main body portion 34 and spring biased into the first expanded position via a spring or pair of springs.

Accordingly and once the first projectile 22 is launched from the internal cavity 24, the pair of wing members 32 will spring into the first expanded position, which is configured to assist in the aerodynamic or gliding abilities of the first projectile or action FIG. 22.

Figure 2C:
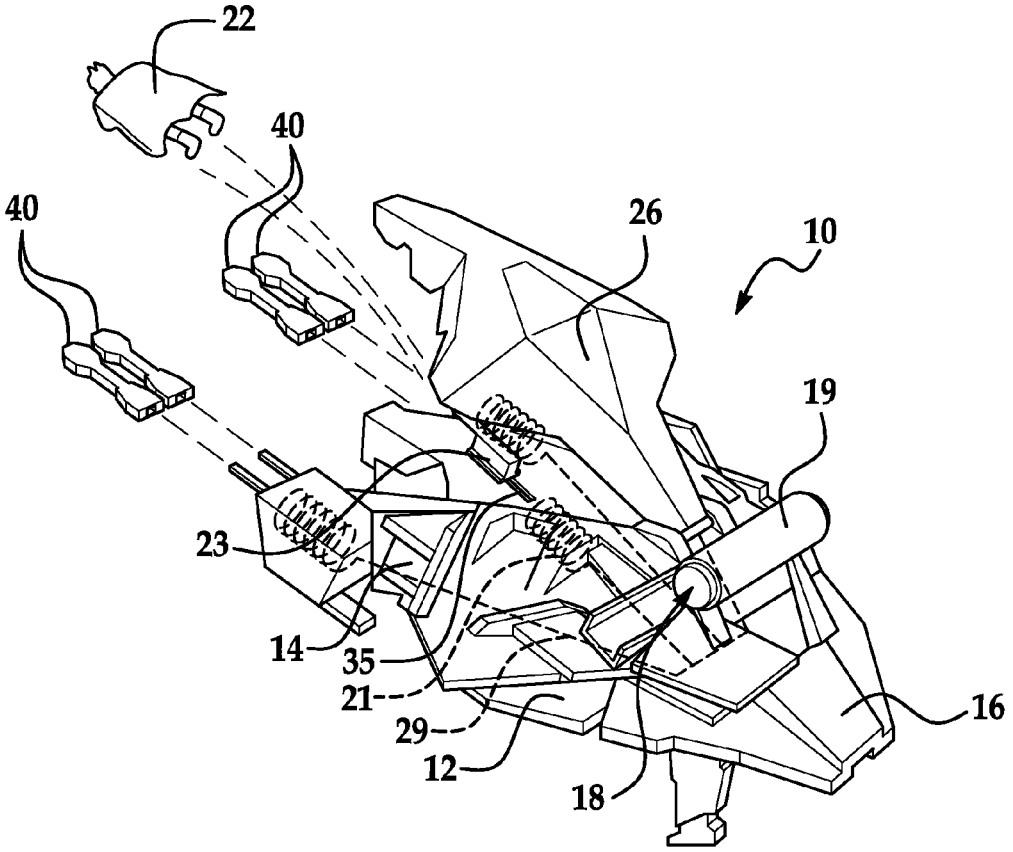

In an exemplary embodiment, operation of the actuation mechanism 18 will cause the cover or canopy 26 to transition from the first closed position to the second open position by for example, a linkage 29 operatively coupling handle 19 to canopy 26. In addition and since the actuation mechanism 18 is operably coupled to launching mechanism 20, operation of the actuation mechanism 18 facilitates movement of the cover 26 between the open and closed positions as well activating the trigger mechanism 20 that simultaneously releases the first projectile 22 from the internal cavity 24. Still further and in yet another embodiment, the linkage 29 is also operatively coupled to projectile launchers 38 such that operation of the actuation mechanism also causes a plurality of projectiles 40 to be launched from projectile launchers 38. For example, at least FIG. 2C illustrates the first projectile or action FIG. 22 and a plurality of second projectiles 40 being launched from the toy 10 after operation of actuation mechanism 18.

Figure 4A:
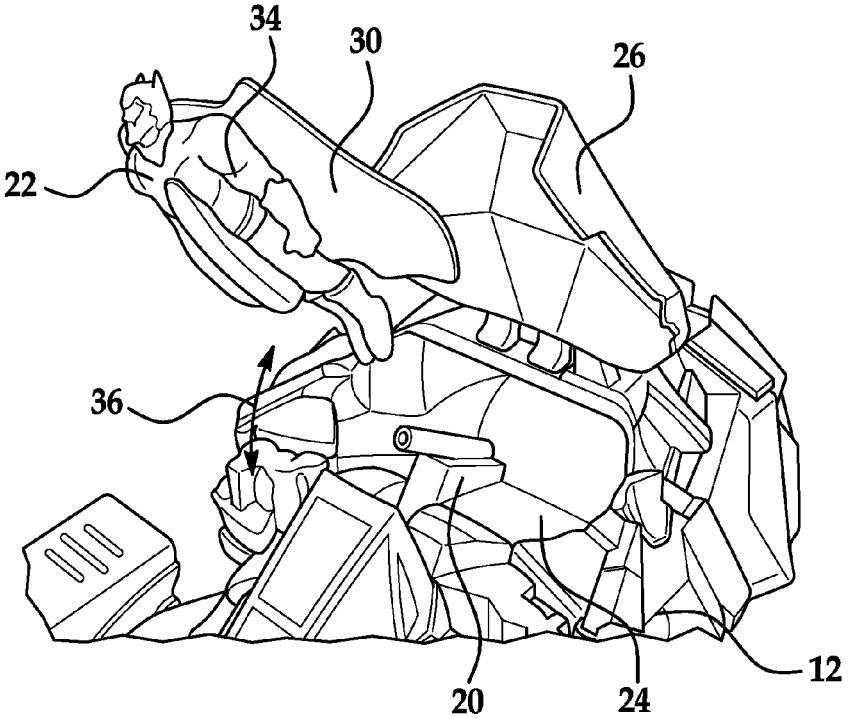
FIGS. 4A-4C are views illustrating another embodiment of the present invention.
Figure 4B:
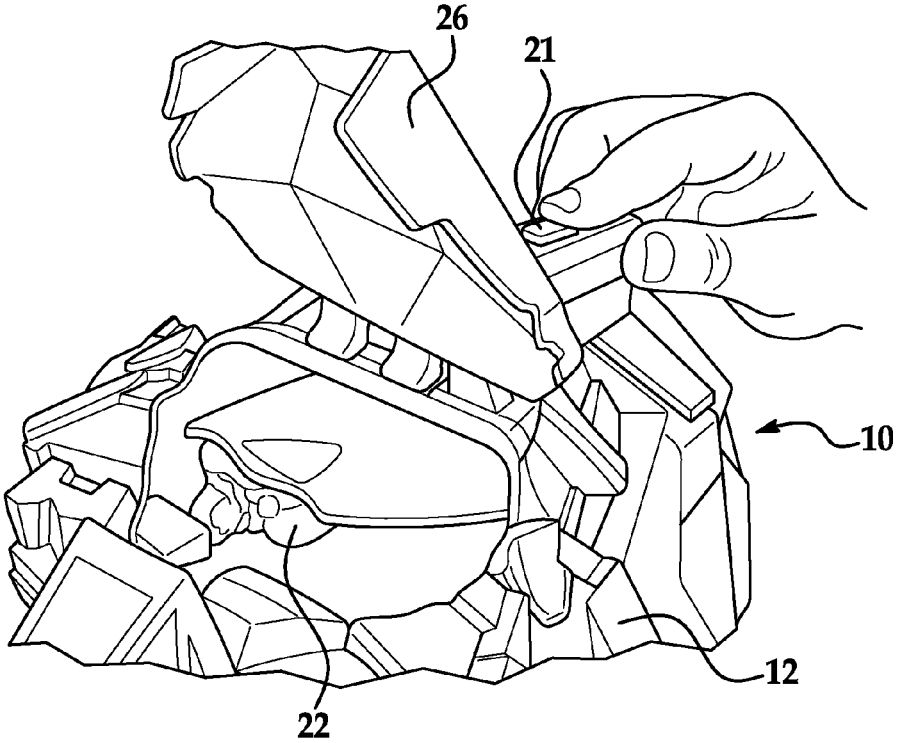
Figure 4C:
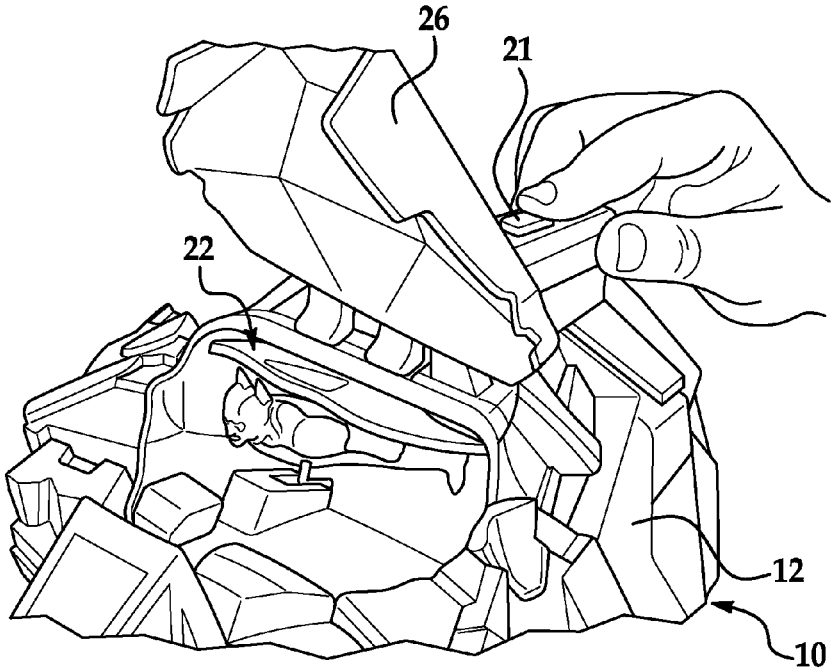

In yet another embodiment and referring at least to FIG. 4A, launching mechanism 20 is configured for pivotal movement with respect to housing 12 in the direction of arrows 36. This pivotal movement of the launch mechanism 20 allows the same to elevate the first projectile 22 from the internal cavity 24 as it is or in anticipation of it being launched from the internal cavity 24. In one embodiment, the pivotal movement of the launch mechanism 22 is also operably coupled to the actuation mechanism 18 such that operation of the same will cause movement of the launching mechanism 20 in the direction of arrows 36.

In one embodiment, the toy 10 is configured to have a plurality of projectile launchers 38 each of which is configured to launch the plurality of second projectiles 40. Similar to the launching mechanism 20 and the first projectile 22 and in one non-limiting embodiment each of the projectile launchers 38 utilizes a spring mechanism having a trigger mechanism coupled to actuation mechanism 18 via a linkage 29 or any other equivalent mechanism such that operation of the actuation mechanism 18 via handle 19 will also launch the plurality of second projectiles 40. In one configuration, the plurality of second projectiles are configured to resemble missiles. Of course, numerous other configurations are considered to be within the scope of exemplary embodiments of the present invention.

Accordingly and in one embodiment, operation of the actuation mechanism 18 causes the cover 26 to move from the first position to the second position and simultaneously launch the first projectile 22 and the plurality of second projectiles 40 from the launching mechanism 20 and the plurality of projectile launchers 38. In an alternative embodiment, operation of the actuation mechanism 18 only causes the first projectile 22 to be launched from the internal cavity 24 of the housing 12. In this embodiment, the subsequent launching of the plurality of second projectiles 40 from the plurality of projectile launchers 38 can be facilitated by independent operation of a trigger mechanism or a subsequent second operation of the actuation mechanism 18. Still further other combinations of launching the first projectile 22 and the plurality of second projectiles 40 are also considered to be within the scope of exemplary embodiments of the present invention.

In addition, movement of the cover or canopy 26 between the first and second positions allows a user access to the internal cavity 24, which allows the first projectile 22 to be inserted therein and secured to launching mechanism 20. This opening and closing of the cover or canopy is, as described above, facilitated by the movement of actuation mechanism 18 operatively coupled thereto by linkage 29 or any other equivalent mechanism. It is also understood that cover or canopy 26 can simply be moved from the first position to the second position to allow a user to secure the first projectile 22 to the launching mechanism 20.

In one embodiment, the toy 10 and accordingly the housing 12 are configured to resemble a vehicle and the cover 26 is configured as a canopy of the vehicle. Non-limiting examples of such vehicles include: flying vehicles, land-based vehicles, water-based vehicles, spaceships, etc. One non-limiting configuration is illustrated in at least FIG. 6.

Figure 5A:
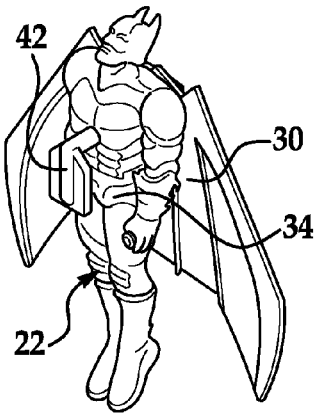
FIGS. 5A-5C are views of a projectile to be launched from the toy.
Figure 5B:
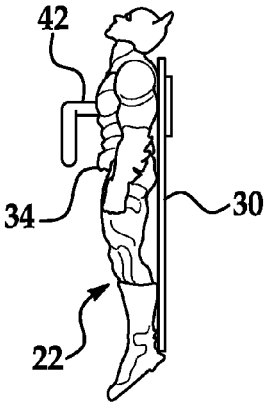
Figure 5C:
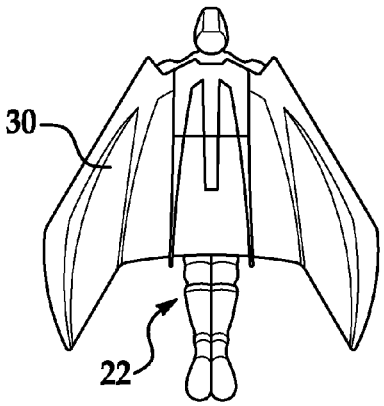

FIGS. 5A-5C illustrate one non-limiting first projectile or action FIG. 22. As illustrated, the main body portion 34 of the first projectile or action FIG. 22 has a feature 42 configured to engage a portion of the launch mechanism 20 located in the internal cavity 24 of the toy vehicle 10.

Accordingly, various embodiments disclosed herein provide a toy having an internal compartment 24 accessible through a pivotally mounted cover 26 that is configured for movement between an open position and a closed position. In the closed position an action figure or first projectile 22 is concealed within the internal compartment 24 and when the cover is in the open position the internal compartment is accessible and the action FIG. 22 can be launched from the internal compartment.

As mentioned above and in one embodiment, the action FIG. 22 is launched from the internal compartment 22. In one embodiment, the action FIG. 22 will have a cape or wing member 30 that is of a unitary construction (e.g., foam, plastic, etc. or other equivalent materials) or alternatively is configured to be biased outwardly after the action FIG. 22 is launched from the internal compartment 24 such that the cape or wing 30 will open and enhance the flying capabilities of the action FIG. 22 as it is launched from the internal compartment (e.g., the cape or wing member has an expanded state for flying and a contracted state when stowed in the compartment). Alternatively, the action FIG. 22 may be simply molded as a unitary structure without a movable cape or wing member 30. In addition, and as discussed above, the toy will have actuation lever 19 or button 21 that facilitates movement of the cover 26 between the open and closed positions as well as a trigger that simultaneously releases at least the first projectile or action FIG. 22 and in another embodiment a plurality of projectiles 40.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A toy, comprising:

a housing;

a cover pivotally mounted to the housing for movement between a first position wherein an internal cavity of the housing is covered and a second position wherein access to the internal cavity is provided;

a launching mechanism located within the internal cavity;

a first projectile configured to be launched from the launching mechanism;

a plurality of second projectiles configured to be launched from a plurality of projectile launchers secured to the housing;

an actuation mechanism coupled to the cover, the launching mechanism and the plurality of projectile launchers, wherein operation of the actuation mechanism causes the cover to move from the first position to the second position and simultaneously launch the first projectile and the plurality of second projectiles from the launching mechanism and the plurality of projectile launchers; and a body member pivotally mounted to the first projectile for movement between a first expanded position with respect to a main body portion of the first projectile and a second contracted position with respect to the main body portion, wherein the body member is spring-biased into the first expanded position.

2. The toy as in claim 1, wherein the first projectile is configured to resemble an action figure.

3. The toy as in claim 1, wherein the plurality of second projectiles are configured to resemble missiles.

4. The toy as in claim 1, wherein the first projectile further comprises an integrally molded wing member.

5. The toy as in claim 4, wherein the integrally molded wing member is constructed out of foam.

6. The toy as in claim 4, wherein the integrally molded wing member is configured to resemble a cape.

7. The toy as in claim 1, wherein the launching mechanism and the plurality of projectile launchers are spring powered.

8. The toy as in claim 1, wherein the launching mechanism is pivotally mounted to the housing and operation of the actuation member causes the launching mechanism to move with respect to the housing.

9. The toy as in claim 1, wherein the housing is configured to resemble a vehicle and the cover is configured as a canopy of the vehicle.

10. The toy as in claim 9, wherein the vehicle is configured to resemble a flying vehicle.

11. The toy as in claim 9, wherein the vehicle is configured to resemble a land-based vehicle.

12. The toy as in claim 1, wherein the actuation mechanism is a lever pivotally mounted to the housing.

13. The toy as in claim 1, wherein the body member is a pair of wing members.

14. The toy as in claim 13, wherein the first projectile is an action figure and the pair of wing members resemble a cape.

15. The toy as in claim 13, wherein the pair of wing members are spring biased into the first expanded position and wherein the internal cavity is configured to retain the pair of wing members in the second contracted position when the first projectile is secured to the launching mechanism within the internal cavity.

16. The toy as in claim 15, wherein the launching mechanism is pivotally mounted to the housing and operation of the actuation member causes the launching mechanism to move with respect to the housing.

17. The toy as in claim 16, wherein the actuation mechanism is a lever pivotally mounted to the housing.

18. A toy vehicle, comprising:

a cover pivotally mounted to the toy vehicle for movement between a first position wherein an internal cavity of the toy vehicle is covered and a second position wherein access to the internal cavity is provided;

a launching mechanism located within the internal cavity;

a first projectile configured to be launched from the launching mechanism, wherein the first projectile is received within the internal cavity and completely concealed by the cover on the cover is in the first position;

a plurality of second projectiles configured to be launched from a plurality of projectile launchers secured to the toy vehicle;

an actuation mechanism located on the toy vehicle and operably coupled to the cover, the launching mechanism and the plurality of projectile launchers, wherein operation of the actuation mechanism causes the cover to move from the first position to the second position and launch the first projectile and the plurality of second projectiles from the launching mechanism and the plurality of projectile launchers; and a body member pivotally mounted to the first projectile for movement between a first expanded position with respect to a main body portion of the first projectile and a second contracted position with respect to the main body portion, wherein the body member is spring-biased into the first expanded position.

19. The toy vehicle in claim 18, wherein the first projectile is configured to resemble an action figure having an integrally molded wing member constructed out of foam.

20. The toy vehicle as in claim 19, wherein the launching mechanism is pivotally mounted to the housing and operation of the actuation member causes the launching mechanism to move with respect to the housing.

* * * * *